United States Patent [19]

Pellow

[11] Patent Number: 4,669,955

[45] Date of Patent: Jun. 2, 1987

[54] AXIAL FLOW TURBINES

[75] Inventor: Terence R. Pellow, Watford, England

[73] Assignee: Rolls-Royce plc, London, England

[21] Appl. No.: 276,254

[22] Filed: Jun. 22, 1981

[30] Foreign Application Priority Data

Aug. 8, 1980 [GB] United Kingdom ..... 8025875

[51] Int. Cl.[4] ..... F01D 11/08

[52] U.S. Cl. ..... 415/174; 415/197

[58] Field of Search ..... 415/196, 197, 174; 427/34

[56] References Cited

U.S. PATENT DOCUMENTS

| | | | |
|---|---|---|---|
| 3,068,016 | 12/1962 | Dega | 415/174 X |
| 3,137,602 | 6/1964 | Lincoln | 415/174 X |
| 3,423,070 | 1/1969 | Corrigan | 415/174 |
| 3,537,713 | 11/1970 | Matthews et al. | 415/174 X |
| 3,545,944 | 12/1970 | Emanuelson | 415/174 UX |
| 3,825,364 | 7/1974 | Halila et al. | 415/174 X |
| 3,879,381 | 4/1975 | Rigney et al. | 415/174 X |
| 3,880,550 | 4/1975 | Corey et al. | 415/174 |
| 3,975,165 | 8/1976 | Elbert et al. | 415/174 X |
| 4,080,204 | 3/1978 | Panzera | 415/174 X |
| 4,135,851 | 1/1979 | Bill et al. | 415/174 |
| 4,247,249 | 1/1981 | Siemers | 415/174 |
| 4,251,272 | 2/1981 | Sara | 415/174 X |
| 4,273,824 | 6/1981 | McComas et al. | 415/174 X |
| 4,289,446 | 9/1981 | Wallace | 415/174 |

FOREIGN PATENT DOCUMENTS

| | | | |
|---|---|---|---|
| 278382 | 12/1927 | United Kingdom | 415/196 |
| 793886 | 4/1955 | United Kingdom | 415/174 |
| 851323 | 10/1958 | United Kingdom . | |
| 1361814 | 12/1971 | United Kingdom . | |
| 1566007 | 12/1977 | United Kingdom . | |
| 2053367A | 7/1979 | United Kingdom . | |
| 2062115 | 5/1981 | United Kingdom | 415/197 |

OTHER PUBLICATIONS

"Navord Report 4893", p. 9.

*Primary Examiner*—Harvey C. Hornsby
*Assistant Examiner*—Frankie L. Stinson
*Attorney, Agent, or Firm*—Cushman, Darby & Cushman

[57] ABSTRACT

An axial flow turbine comprises an annular array of rotatable turbine blades which are surrounded by a shroud ring. An open honeycomb structure is attached to the shroud ring, the open cells of which honeycomb structure contain an abradable material. The honeycomb structure is totally covered by an impervious coating which contains a ceramic material. The impervious coating resists oxidation and/or erosion of the abradable material.

8 Claims, 2 Drawing Figures

AXIAL FLOW TURBINES

This invention relates to axial flow turbines and in particular to axial flow turbines suitable for use in gas turbine engines.

An important factor in the efficiency of the axial flow turbines of gas turbine engines is the clearance between the tips of each array of rotary aerofoil blades and the portion of stationary engine structure which surrounds them. Thus if the clearance is too great, gas leakage occurs across the blade tips, thereby lowering the overall efficiency of the turbine. If the clearance is reduced to a value which is acceptable so far as turbine efficiency is concerned, there is an increased danger that under certain turbine conditions, contact will occur between the blade tips and the surrounding engine structure. Since such contact is unacceptable because of the resultant damage which is likely to occur, it is usual to provide a layer of an abradable material on the surrounding stationary engine structure. Thus if contact occurs between the blade tips and the abradable material, a small amount of the abradable material is removed by the blade tips without any serious damage occurring to the blade tips or the surrounding engine structure.

In the pursuit of greater gas turbine engine efficiency, the temperatures of gases passing through the turbines of such engines are continually being increased. Such high temperature gases, however, frequently have an adverse effect on the abradable seal material leading to its erosion or oxidation. This inevitably results in a reduction in the thickness of the abradable material so that the gap between the abradable material and the blade tips increases, thereby reducing turbine efficiency.

It is an object of the present invention to provide an axial flow turbine suitable for a gas turbine engine in which erosion and/or oxidation of the abradable material is substantially reduced or eliminated.

According to the present invention, an axial flow turbine suitable for a gas turbine engine comprises an annular array of rotatable aerofoil blades and stationary turbine structure having an annular radially inwardly facing portion positioned adjacent and radially outwardly of said aerofoil blades, said annular radially inwardly facing portion being provided with a coating of an abradable material, said coating of an abradable material being totally covered by an impervious coating comprising a ceramic material.

Said abradable material is preferably supported by an open cell structure attached to said annular radially inwardly facing portion of said stationary turbine structure.

Said open cell structure may be in the form of an open honeycomb.

The thickness of said impervious coating comprising a ceramic material is preferably approximately 25% of the thickness of said abradable material.

Said abradable material may comprise sintered metallic particles, each particle comprising an aluminium core having a nickel coating.

Said impervious coating comprising a ceramic material preferably comprises three layers: a bond coat applied to said abradable material, an intermediate coat applied to said bond coat and a top coat applied to said intermediate coat.

Said bond coat preferably comprises flame or plasma sprayed fabricated particles of a particulate nickel-chromium alloy and particulate aluminium bonded together with an organic binder.

Said intermediate coat preferably comprises a flame or plasma sprayed admixture of particles of a particulate nickel-chromium alloy and particulate aluminium together with an organic binder and particles containing zirconium oxide and magnesium oxide.

Said top coat preferably comprises flame or plasma sprayed particles containing zirconium oxide and magnesium oxide.

Said stationary turbine structure having an annular radially inwardly facing portion may be a shroud ring.

The invention will now be described, by way of example with reference to the accompanying drawings in which.

Figure 1:
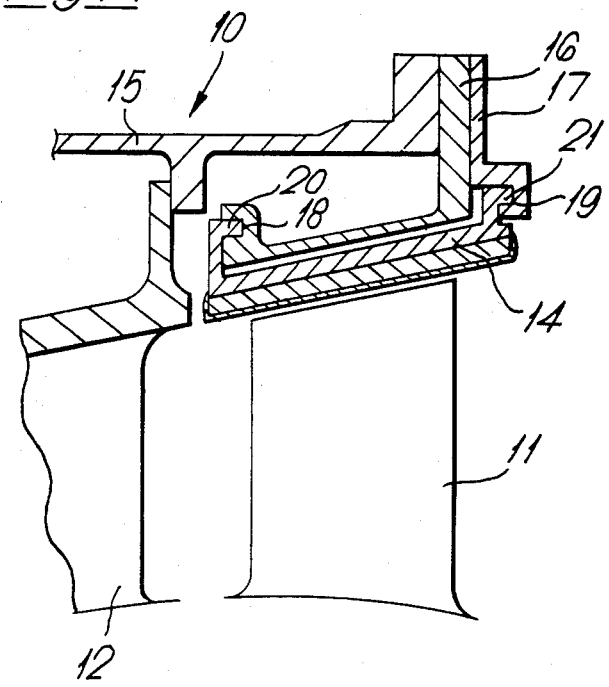
FIG. 1 is a sectioned side view of a portion of an axial flow turbine in accordance with the present invention.

With reference to FIG. 1, an axial flow turbine 10 suitable for a gas turbine engine (not shown) comprises alternate annular arrays of stationary and rotary aerofoil blades. In the turbine portion shown, an array of rotary aerofoil blades 11 is located downstream (with respect to the gas flow through the turbine 10) of a stationary array of nozzle guide vanes 12. The rotary aerofoil blades 11 are without shrouds at their radially outer tips 13 and consequently in order to minimise leakage of the turbine gases across the tips 13, they are surrounded by an annular shroud ring 14.

The shroud ring 14 is fixed to the casing 15 of the turbine by means of two mounting rings 16 and 17. The mounting rings 16 and 17 are provided with annular grooves 18 and 19 respectively which are adapted to receive corresponding annular tongues 20 and 21 provided on the shroud ring 14.

Figure 2:
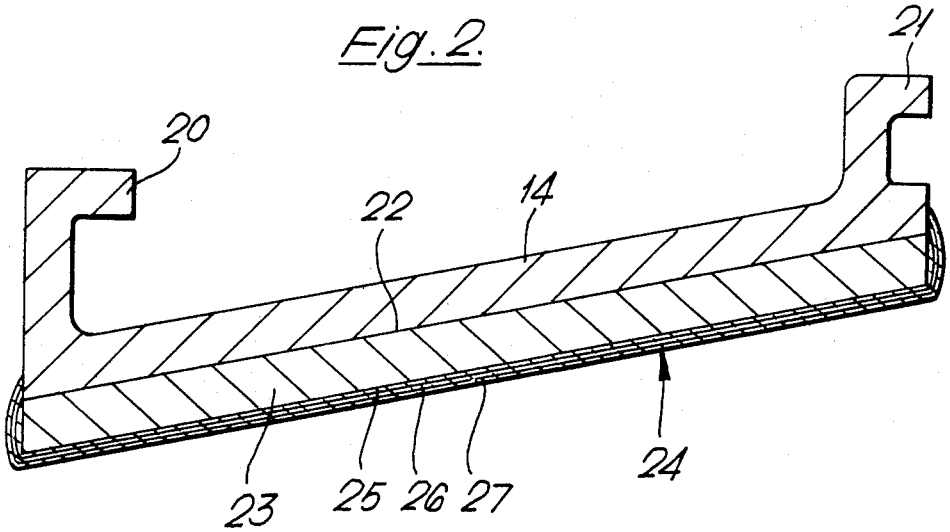
FIG. 2 is an enlarged view of part of the turbine portion shown in FIG. 1.

The shroud ring 14 is provided with an annular radially inwardly facing portion 22 which has a metallic open honeycomb structure 23 brazed to it as can be seen in FIG. 2. Each of the open cells of the honeycomb structure 23 is filled with an abradable material which is sintered in place in the cells. The abradable material may, for instance, consist of sintered particles of the metal powder known as Metco 404 and marketed by Metco Inc. Metco 404 consists essentially of particles of aluminium, each coated with nickel. It will be appreciated however that other suitable abradable materials could be used to coat the inwardly facing portion 22 of the shroud ring 14 and that means other than a honeycomb structure 23 could be used to support the abradable material.

The abradable material is totally covered by an impervious coating 24 which comprises a ceramic material. More specifically the impervious coating 24 consists of three separately flame or plasma sprayed layers: a first bond cpat 25 applied to the abradable material and consisting of particles of a particulate nickel-chromium alloy and particulate aluminium bonded by an organic binder eg. Metco 443, a second intermediate coat 26 consisting of an admixture of particles of the type used in the bond coat and particles containing magnesium oxide and zirconium oxide e.g. Metco 441 and a top coat 27 consisting of particles containing magnesium oxide and zirconium oxide e.g. Metco 210. Metco 443, 441 and 210 are all marketed by Metco Inc.

The impervious coating 24 is approximately 25% of the thickness of the abradable material supported by the honeycomb structure 23. Thus in one particular embodiment of the present invention, the abradable material was 0.060" thick and the impervious coating 0.015" thick. Generally speaking we prefer that the intermediate and top layers 26 and 27 of the impervious coating 24 are of the same thickness and that the bond coat is half that thickness.

The impervious coating 24 serves two functions. The first is to protect the abradable material from oxidation and erosion by providing an impervious barrier between the abradable material and the hot gases which pass in operation through the turbine 10. The second is to provide a thermally insulating layer which prevents damage to the abradable material 24 and in turn the shroud ring 14 through overheating.

The shroud ring 14 is so located on the turbine casing 15 that the clearance between the impervious coating 24 and the aerofoil blade 11 tips is such that leakage of turbine gases across the tips is as small as possible. If, as a result of a turbine malfunction, contact occurs between the aerofoil blade 11 tips and the impervious coating 24, the coating 24 will break away and the blade 11 tips abrade the abradable material. Consequently damage to the blade 11 tips and the shroud ring 14 will be minimal. If contact does occur and the impervious coating 24 and the abradable material are damaged, it will be necessary to remove the shroud ring 14 from the turbine 10 and apply new layers of the abradable material and the impervious material. This is of course far cheaper than would have been the case if the shroud ring 14 and aerofoil blades 11 had been damaged and consequently repaired or replaced.

It will be seen therefore that the provision of an impervious coating 24 on the abradable material ensures that none of the abradable material oxidises or erodes in use. Consequently the clearance between the impervious layer 14 and the tips of the aerofoil blades 11 will not, assuming no contact between the two, increase, through oxidation or erosion so that as a result there will not be a deterioration in the efficiency of the turbine 10.

Although the present invention has been described with reference to an axial flow turbine provided with unshrouded aerofoil blades, it will be appreciated that it is also applicable to turbines which have shrouded aerofoil blades. Thus shrouded aerofoil blades are provided with a shroud portion at their tips. Each shroud portion is provided with finned portions which, in the event of a turbine malfunction, abrade the abradable material.

I claim:

1. An axial flow turbine suitable for a gas turbine engine comprising an annular array of rotatable turbine blades and stationary turbine structure having an annular radially inwardly facing portion positioned adjacent and radially outwardly of said turbine blades, said annular radially inwardly facing portion being provided with a coating of an abradable material supported by an open cell honeycomb structure attached to said annular radially inwardly facing portion of said stationary turbine structure, said coating of an abradable material being totally covered by an impervious coating comprising a ceramic material.

2. An axial flow turbine as claimed in claim 1 wherein the thickness of said impervious coating comprising a ceramic material is approximately 25% of the thickness of said abradable material.

3. An axial flow turbine as claimed in claim 1 wherein said abradable material comprises sintered metallic particles, each particle comprising an aluminium core having a nickel coating.

4. An axial flow turbine as claimed in claim 1 wherein said coating comprising a ceramic material comprises three layers: a bond coat applied to said abradable material, an intermediate coat applied to said bond coat, and a top coat applied to said intermediate coat.

5. An axial flow turbine as claimed in claim 4 wherein said bond coat comprises flame or plasma sprayed fabricated particles of a particulate nickel chromium alloy and particulate aluminium bonded together with an organic binder.

6. An axial flow turbine as claimed in claim 5 wherein said intermediate coat comprises a flame or plasma sprayed admixture of particles of a particulate nickel-chromium alloy and particulate aluminium bonded together with an organic binder and particles containing zirconium oxide and magnesium oxide.

7. An axial flow turbine as claimed in claim 6 wherein said top coat comprises flame or plasma sprayed particles containing zirconium oxide and magnesium oxide.

8. An axial flow turbine as claimed in claim 1 wherein said stationary turbine structure having an annular radially inwardly facing portion is a shroud ring.

* * * * *